United States Patent [19]

Shuck et al.

[11] 4,249,776

[45] Feb. 10, 1981

[54] METHOD FOR OPTIMAL PLACEMENT AND ORIENTATION OF WELLS FOR SOLUTION MINING

[75] Inventors: David L. Shuck; Calvin C. Chien, both of Littleton, Colo.

[73] Assignee: Wyoming Mineral Corporation, Lakewood, Colo.

[21] Appl. No.: 43,530

[22] Filed: May 29, 1979

[51] Int. Cl.[3] ..... E21B 43/30; E21C 41/14

[52] U.S. Cl. ..... 299/4; 166/245

[58] Field of Search ..... 166/245, 271, 308; 299/4

[56] References Cited

U.S. PATENT DOCUMENTS

| | | | |
|---|---|---|---|
| 2,818,240 | 12/1957 | Livingston | 299/4 |
| 3,309,140 | 3/1967 | Gardner et al. | 299/4 |
| 3,810,510 | 5/1974 | Fitch | 166/271 |
| 3,841,705 | 10/1974 | Girard | 166/271 |
| 4,005,750 | 2/1977 | Shuck | 166/245 |

OTHER PUBLICATIONS

A Method for Analyzing a Drawdown Test in Anisotropic Aquifers, Hantush, Water Resources Research, 1966, pp. 281–285.

*Primary Examiner*—William F. Pate, III

*Attorney, Agent, or Firm*—L. A. DePaul; Z. L. Dermer

[57] ABSTRACT

A method for optimal placement and orientation of a well field for solution mining comprises first determining the direction and magnitude of the major and minor axes of transmissivity of the ore body. Then, determining the location of the injection and recovery wells based on the magnitude and orientation of the major and minor axes of transmissivity.

13 Claims, 7 Drawing Figures

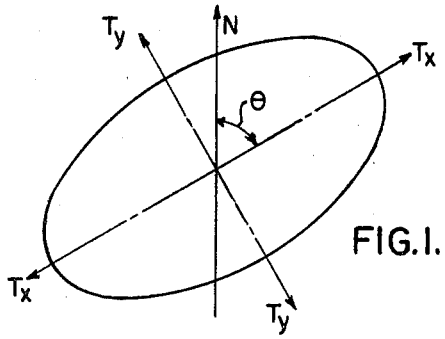
FIG. 1.
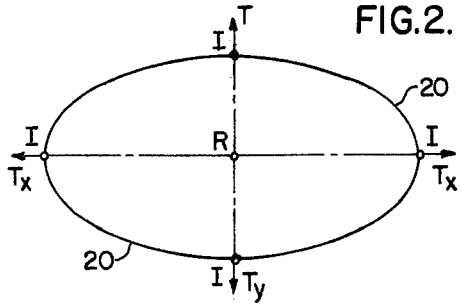
FIG. 2.
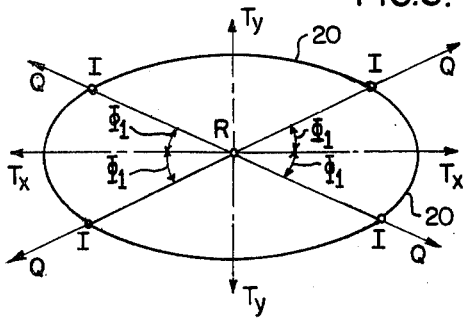
FIG. 3.
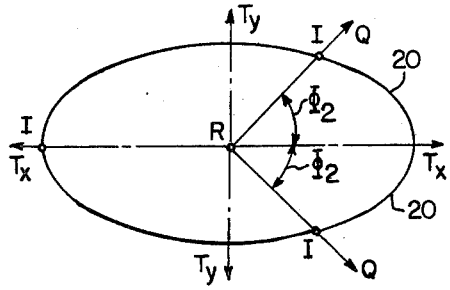
FIG. 4.
FIG. 5.
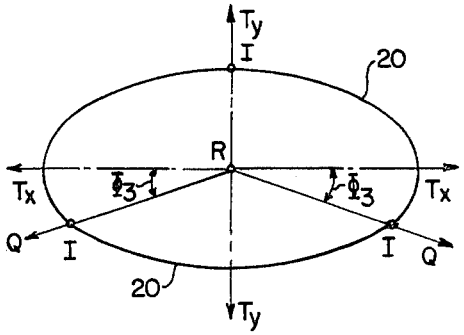
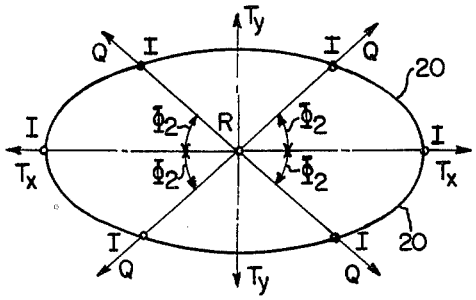
FIG. 6.
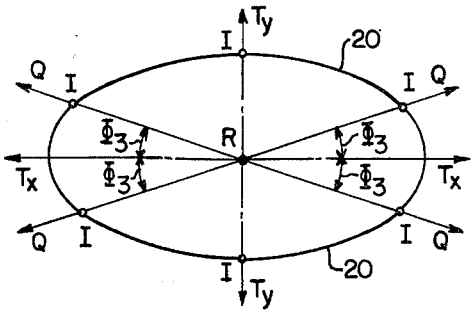
FIG. 7.

METHOD FOR OPTIMAL PLACEMENT AND ORIENTATION OF WELLS FOR SOLUTION MINING

BACKGROUND OF THE INVENTION

This invention relates to in-situ solution mining and more particularly to the optimal placement and orientation of the wells comprising a well field for solution mining.

In conventional solution mining practice, a plurality of injection and recovery wells are drilled and completed in a regular repeating fashion. A leach solution is then introduced into the ore body through the injection well and is subsequently recovered by the adjacent recovery or production well. While in contact with the ore body, the leach solution reacts with the mineralization present which may contain uranium and causes selected minerals to become dissolved in the leach solution. The pregnant leach solution is treated aboveground to remove the mineral values therefrom and the leach solution is refortified and recirculated through the ore body.

There are numerous well field patterns that may be utilized in solution mining such as, among others, a 4-spot, 5-spot, or 7-spot pattern. The choice of pattern types may depend upon the permeability of the ore body or the geometric configuration of the ore body. For example, a 4-spot pattern may be more suitable to a highly permeable ore body whereas a 7-spot pattern may be more suitable to a less permeable ore body because the 7-spot pattern has a greater number of injection wells per number of recovery wells for a given cell than does the 4-spot pattern. However, the geometric nature of the 7-spot pattern limits its usefulness in a narrow-winding ore formation due to its repetitive geometric characteristics. Because of these considerations, a 5-spot pattern is the most common cell pattern.

Besides cell pattern, the cell area is an important factor that must be determined in selecting and formulating a well field configuration. The cell area is usually defined to be the area within the perimeter defined by the injection wells surrounding a particular recovery well. There are many techniques for determining the optimum cell area, most of which concern the economics of well field installation and operation. Some of the considerations involved in optimizing cell area are:

(a) mineral concentration per unit area;
(b) cost of installing and completing a well at the depth of mineralization; and
(c) rate of reagent consumption and mineral recovery per well.

With these considerations taken into account, standard optimization techniques can be utilized to determine the optimum cell area for a well field.

Although techniques are available to determine the type of cell pattern and cell area to use with a given ore body or portion of an ore body, the prior art does not describe a method for determining the optimum location of the injection wells relative to the recovery well of a typical cell and their orientation with respect to the ore body. Therefore, what is needed is a method for determining the optimum placement and orientation of a well field pattern for solution mining.

SUMMARY OF THE INVENTION

A method for optimal placement and orientation of the wells comprising a well field for solution mining comprises first determining the direction and magnitude of the major and minor axes of transmissivity of the ore formation. With the cell pattern and area determined, the location of the injection and recovery wells based on the magnitude and orientation of major and minor axes of transmissivity may be determined.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

FIG. 1 is a diagram showing the relationship of the major and minor axes of transmissivity;

FIG. 2 is a diagram of the diamond-shaped 5-spot pattern;

FIG. 3 is a diagram of the rectangularly-shaped 5-spot pattern;

FIG. 4 is a diagram of the Type I, 4-spot pattern;

FIG. 5 is a diagram of the Type II, 4-spot pattern;

FIG. 6 is a diagram of the Type I, 7-spot pattern; and

FIG. 7 is a diagram of the Type II, 7-spot pattern.

DESCRIPTION OF THE PREFERRED EMBODIMENT

The non-homogeneous characteristics of a given ore formation can be determined by a variety of bore hole logging and core analyses methods. Similarly, bore hole test methods can be used to determine and quantify the anisotropic characteristics of the formation. Properly accounting for the anisotropic permeability characteristics of the formation can significantly improve the rate of mineral extraction and aquifer restoration. The invention, disclosed herein, relates optimum well field orientation and configuration to the local anisotropy of the mineralized formation with regard to solution flow.

The formation parameters of interest for a well field design are the magnitudes and orientation of the principal transmissivities or permeabilities which characterize the distribution of solution flow in response to a given pressure gradient. The two dimensional anisotropy of a mineralized aquifer can be determined by established pump tests and data interpretation methods. For example, in "A Method for Analyzing a Drawdown Test in Anisotropic Aquifers" by Hantush and Thomas, *Water Resources Research,* Vol. 2, No. 2, Second Quarter 1966, pp. 281–285 and in "Analysis of Data from Pumping Tests in Anisotropic Aquifers" by Hantush, *Journal of Geophysical Research,* Vol. 71, No. 2, Jan. 15, 1966, pp. 421–426, there are described methods for determining the hydraulic properties of homogeneous anisotropic aquifers. From these methods one can determine the magnitude and direction of the major axis of transmissivity, Tx, (the direction of highest local permeability), and the magnitude and direction of the minor axis of transmissivity, Ty, (the direction of lowest local permeability). Geometrically this set of parameters describes a family of curves and their orientation with respect to some reference direction such as true or magnetic North. Typically, this family of curves can be approximated by a family of concentric elipses whose major and minor axes are perpendicular and proportional to the square roots of the magnitudes of the major and minor transmissivities respectively.

In well field design it is generally preferable to adopt a well field pattern based on repetition of an elementary geometric pattern in order to simplify installation and maintenance of related surface equipment. This basic pattern is generally referred to as a cell. It has been found that the optimum cell configuration and orientation for a well field are uniquely related to the two dimensional hydrologic characteristics of the formation under consideration. Specifically, for a given cell pattern:

(1) the optimum cell configuration corresponds to that of the largest cell of a particular type which can be inscribed within one member of the family of curves correlating the formation transmissivities, and (2) the optimum cell orientation corresponds to that in which the major cell axis (longest cell dimension) parallels the major axis of transmissivity.

The cell configurations and orientations indicated above are optimal in the sense that:

(1) the resultant fluid velocity distribution is as uniform as practically attainable within a given cell pattern and prevailing formation conditions, and (2) the variance of the fluid velocity distribution is minimized which results in the rate of mineral leaching being maximized for a given cell geometry and formation characteristics.

Referring to FIG. 1, a family of equal drawdown curves 20 which is generally approximated by a family of elipses are determined by pump tests in accordance with standard hydrological methods. By definition, equal drawdown curve 20 is the locus of all points at which the drawdown induced by pumping well R is the same at any given instant of time. Tx and Ty are defined as stated previously and are indicated as shown in FIG. 1. $\theta$ is defined as the angle between Tx and true or magnetic North.

Once Tx and Ty have thus been determined, the next step is to select an appropriate well field pattern. For example, a 4-spot, 5-spot, or a 7-spot cell pattern. This can be accomplished utilizing commonly understood procedures which differ depending on the particular ore body in question.

Next, the cell area is determined also in accordance with standard procedures. As previously described, these procedures involve optimizing the cell area on an economic basis. With the well field pattern and cell area determined, the cell configuration and orientation may be determined next.

FIVE SPOT PATTERN

Referring now to FIG. 2, the most commonly used well field pattern is the 5-spot pattern. There are two optimal geometric configurations for the 5-spot pattern available, the rectangularly-shaped 5-spot or the diamond-shaped 5-spot both of which have the production or recovery well, R, located at their center. The diamond-shaped 5-spot pattern will be considered first.

In implementing the optimal configuration and orientation of the 5-spot pattern, an equal drawdown curve 20 which in this case is an elipse is constructed such that its major axis is parallel to the major axis of transmissivity, Tx, and has a magnitude proportional to the square root of the major axis of transmissivity, Tx. The minor axis of the elipse is parallel to the minor axis of transmissivity, Ty, and has a magnitude proportional to the square root of the minor axis of transmissivity, Ty. Since there are a family of equal drawdown curves 20 which could be so constructed, the equal drawdown curve 20 is selected to be the smallest elipse that will circumscribe a diamond-shaped 5-spot pattern having a given cell area as previously determined. Common mathematical optimization analysis indicates that such an equal drawdown curve 20 should have an area equal to $\pi/2$ times that of the chosen cell area. At this point the method defines a single equal drawdown curve 20 with the recovery well, R, located at its center.

As shown in FIG. 2, a well drilled at any point on equal drawdown curve 20 will produce the same solution flow rates. Thus, what needs to be determined is the location of the four injection wells for the diamond-shaped 5-spot pattern.

Still referring to FIG. 2, the location of the four injection wells, I, for the diamond-shaped 5-spot pattern are at the intersections of the major axis of transmissivity, Tx, with equal drawdown curve 20 and the intersections of the minor axis of transmissivity, Ty, with equal drawdown curve 20. The next diamond-shaped 5-spot pattern is made by extending the pattern of the first diamond-shaped 5-spot pattern until the major and minor axes of transmissivity have changed sufficiently to warrant beginning a new pattern. Of course, the new pattern will be made based on the basic assumptions as described herein. This method results in a regular-repeating diamond-shaped 5-spot pattern which produces an essentially uniform solution flow through the ore body with maximum mineral leaching.

Referring now to FIG. 3, the area of the equal drawdown curve 20 for the rectangularly-shaped 5-spot pattern is chosen to be the smallest elipse that will circumscribe a rectangularly-shaped 5-spot pattern having the cell area as previously determined. As mathematically determined, the area of such an equal drawdown curve 20 should be equal to $\pi/2$ times the chosen cell area. Again, the recovery well, R, is located at the the center of the elipse. The first of the four injection wells, I, for the rectangularly-shaped 5-spot pattern is located at the intersection of a ray Q with equal drawdown curve 20 where Q is a ray at an angle $\Phi_1$ from the major axis of transmissivity, Tx. The remaining three injection wells I are similarly located in the remaining three quadrants as shown in FIG. 3. The angle $\Phi_1$ is related to the magnitudes of the major and minor transmissivities by the following equation:

$$\cos \Phi_1 = \sqrt{\frac{Tx}{Tx + Ty}}$$

Likewise, the adjacent 5-spot patterns are mere repetitions of this original pattern within the section of the well field wherein the axes of transmissivity are substantially the same. This variation of the method results in a regular-repeating rectangularly-shaped 5-spot pattern.

THE 4-SPOT PATTERN

Referring now to FIG. 4, to implement an optimal 4-spot pattern, an equal drawdown curve 20 is constructed such that the major axis of the elipse is parallel to the major axis of transmissivity Tx and has a magnitude proportional to the square root of the major axis of transmissivity, Tx. The minor axis of the elipse is parallel to the minor axis of transmissivity, Ty, and has a magnitude proportional to the square root of the minor axis of transmissivity within the ore body. The geometric center of the constructed elipse is designated the recovery well, R.

There are two types of 4-spot patterns capable of being implemented at this point and are referred to as Type I, and Type II, 4-spot patterns. In both types, the area of the elipse is chosen to be the smallest elipse that will circumscribe a triangle having an area equal to the chosen cell area. In both types the area of elipse 20 should be equal to $16\pi/27$ times the chosen cell area. In the Type I pattern shown in FIG. 4, the intersection of the major axis of transmissivity, Tx, with equal drawdown curve 20 is one injection well, I, while the other two injection wells are located at the intersection of ray Q with the elipse at angle $\pm\Phi_2$ where:

$$\cos \Phi_2 = \sqrt{\frac{Tx}{Tx + 3Ty}}$$

Referring to FIG. 5, in the Type II 4-spot pattern, the intersection of the minor axis of transmissivity, Ty, and equal drawdown curve 20 is the first injection well, I. The other two injection wells are located at the intersection of ray Q at angle $\Phi_3$ with elipse 20 in the two quandrants as shown in FIG. 5 where:

$$\cos \Phi_3 = \sqrt{\frac{3Tx}{3Tx + Ty}}$$

THE SEVEN-SPOT PATTERN

Referring to FIG. 6, an equal drawdown curve 20 is constructed with its major axis parallel to the major axis of transmissivity, Tx, and with a magnitude proportional to the square root of the major axis of transmissivity. The minor axis is parallel to the minor axis of transmissivity, Ty, and has a magnitude proportional to the square root of the minor axis of transmissivity. The area of the elipse is chosen to be the smallest elipse that will circumscribe a hexagon having an area equal to $2\pi/\sqrt{27}$ times the area of the chosen cell area. The recovery well, R, is located at the center of the elipse. Again, there are two types of implementation at this point. For the Type I implementation, three of the six injection wells are located on the perimeter of the elipse according to Type I implementation for the 4-spot pattern. The remaining three injection wells are located at the intersection of the elipse corresponding to a reflection about its minor axis of the initial set of injection wells.

Referring to FIG. 7, in the 7-spot Type II implementation, three of the six injection wells are located on the perimeter of the elipse according to the procedure outlined for Type II implementation of the 4-spot pattern as previously described. The remaining three injection wells are located at the intersection of the elipse corresponding to a reflection about its major axis of the initial set of injection wells.

It should be noted that while the location and orientation of the injection and recovery cells for the above-identified cell patterns are considered optimal, some deviation from their exact locations can result in effective solution flow in accordance with the disclosed method.

Therefore, it can be seen that the invention provides a method for optimal placement and orientation of wells for a well field for solution mining.

We claim as our invention:

1. A method for solution mining well placement comprising:

selecting an appropriate cell pattern;

selecting an appropriate cell area corresponding to said cell pattern;

determining the major and minor axes of transmissivity for the well field; and installing said cell pattern so that the major axis of said cell is substantially parallel to the direction of said major axis of transmissivity.

2. The method according to claim 1 wherein said method further comprises placing a recovery well at approximately the center of said cell pattern.

3. The method according to claim 2 wherein said method further comprises:

constructing an elipse having its major axis parallel to said major axis of transmissivity and having its minor axis parallel to said minor axis of transmissvity; and installing injection wells substantially along the perimeter of said elipse.

4. The method according to claim 3 wherein said method further comprises constructing said elipse to be the smallest elipse that will substantially circumscribe said cell pattern.

5. A method for solution mining well placement for a 5-spot cell pattern comprising:

selecting an appropriate cell area corresponding to said 5-spot cell pattern;

determining the major and minor axes of transmissivity for the well field;

constructing an elipse having its major axis substantially parallel to said major axis of transmissivity and having its minor axis substantially parallel to said minor axis of transmissivity;

installing a recovery well approximately at the center of said elipse; and installing injection wells substantially along the perimeter of said elipse.

6. The method according to claim 5 wherein said method further comprises installing said injection wells at the intersection of said elipse with said major and minor axes of said elipse.

7. The method according to claim 5 wherein said method further comprises installing said injection wells at the intersection of said elipse with a ray emanating from said recovery well at an angle, $\Phi_1$, from said major axis of said elipse where $$\cos \Phi_1 = \sqrt{\frac{Tx}{Tx + Ty}}$$

and where

Tx=magnitude of the major axis of said elipse, and

Ty=magnitude of the minor axis of said elipse.

8. A method for solution mining well placement for a 4-spot cell pattern comprising:

selecting an appropriate cell area corresponding to said 4-spot cell pattern;

determining the major and minor axes of transmissivity for the well field;

constructing an elipse having its major axis substantially parallel to said major axis of transmissivity and having its minor axis substantially parallel to said minor axis of transmissivity;

installing a recovery well approximately at the center of said elipse; and installing injection wells substantially along the perimeter of said elipse.

9. The method according to claim 8 wherein said method further comprises:

installing one of said injection wells at the intersection of said elipse and the major axis of said elipse; and installing two of said injection wells at the intersection of said elipse and a ray emanating from said recovery well at an angle, $\Phi_2$, from said major axis where $$\cos \Phi_2 = \sqrt{\frac{Tx}{Tx + 3Ty}}$$

and where

Tx=magnitude of the major axis of said elipse; and

Ty=magnitude of the minor axis of said elipse.

10. The method according to claim 8 wherein said method further comprises:

installing one of said injection wells at the intersection of said elipse and the minor axis of said elipse; and installing two of said injection wells at the intersection of said elipse and a ray emanating from said recovery well at an angle, $\Phi_3$, from said major axis where $$\cos \Phi_3 = \sqrt{\frac{3Tx}{3Tx + Ty}}$$

and where

Tx=magnitude of the major axis of said elipse; and

Ty=magnitude of the minor axis of said elipse.

11. A method for solution mining well placement for a 7-spot cell pattern comprising:

selecting an appropriate cell area corresponding to said 7-spot cell pattern;

determining the major and minor axes of transmissivity for the well field;

constructing an elipse having its major axis substantially parallel to said major axis of transmissivity and having its minor axis substantially parallel to said minor axis of transmissivity;

installing a recovery well approximately at the center of said elipse; and installing injection wells substantially along the perimeter of said elipse.

12. The method according to claim 11 wherein said method further comprises:

installing two of said injection wells at the intersection of said major axis of said elipse and said elipse; and installing four of said injection wells at the intersection of said elipse and a ray emanating from said recovery well at an angle, $\Phi_2$, from said major axis where $$\cos \Phi_2 = \sqrt{\frac{Tx}{Tx + 3Ty}}$$

and where

Tx=magnitude of the major axis of said elipse; and

Ty=magnitude of the minor axis of said elipse.

13. The method according to claim 11 wherein said method further comprises:

installing two of said injection wells at the intersection of said minor axis of said elipse and said elipse; and installing four of said injection wells at the intersection of said elipse and a ray emanating from said recovery well at an angle, $\Phi_3$, from said major axis where $$\cos \Phi_3 = \sqrt{\frac{3Tx}{3Tx + Ty}}$$

and where

Tx=magnitude of the major axis of said elipse; and

Ty=magnitude of the minor axis of said elipse.

* * * * *